US005536980A

United States Patent [19]

Kawate et al.

[11] Patent Number: 5,536,980

[45] Date of Patent: Jul. 16, 1996

[54] HIGH VOLTAGE, HIGH CURRENT SWITCHING APPARATUS

[75] Inventors: Keith W. Kawate, Attleboro Falls, Mass.; John J. Chrupcala, Warren; Eric K. Larson, Narragansett, both of R.I.; Thomas R. Maher, Plainville, Mass.

[73] Assignee: Texas Instruments Incorporated, Dallas, Tex.

[21] Appl. No.: 978,557

[22] Filed: Nov. 19, 1992

[51] Int. Cl.[6] ..... H01H 9/30

[52] U.S. Cl. ..... 307/116; 307/132 E; 361/13

[58] Field of Search ..... 361/2, 3, 7, 8–11, 361/13, 42, 93, 94, 99, 101, 103–106, 111, 139, 160, 161, 165; 307/116, 117, 131–132 T, 134, 135, 139–141.4

[56] References Cited

U.S. PATENT DOCUMENTS

| | | | |
|---|---|---|---|
| 2,958,808 | 11/1960 | Miller | 307/325 |
| 3,075,124 | 1/1963 | Bagno | 361/11 |
| 3,184,619 | 5/1965 | Zydney | 307/134 |
| 3,264,519 | 8/1966 | Minck | 315/206 |
| 3,588,605 | 6/1971 | Casson | 361/13 |
| 3,673,436 | 6/1972 | Adams, Jr. | 307/132 |
| 3,870,905 | 3/1975 | Chikazawa | 307/254 |
| 3,912,941 | 10/1975 | Passarella | 361/2 |
| 4,250,531 | 2/1981 | Ahrens | 307/135 |
| 4,438,472 | 3/1984 | Woodworth | 307/134 |
| 4,598,330 | 7/1986 | Woodworth | 361/13 |
| 4,618,906 | 10/1986 | Paice et al. | 361/57 |
| 4,631,621 | 12/1986 | Howell | 361/13 |
| 4,636,906 | 1/1987 | Anderson et al. | 361/13 |
| 4,636,907 | 1/1987 | Howell | 307/137 |
| 4,658,320 | 4/1987 | Hongel | 361/13 |
| 4,685,019 | 8/1987 | Needham | 361/2 |
| 4,700,256 | 10/1987 | Howell | 361/13 |
| 4,723,187 | 2/1988 | Howell | 361/13 |
| 4,745,511 | 5/1988 | Kugelman et al. | 361/8 |
| 4,760,483 | 7/1988 | Kugelman et al. | 307/135 |
| 4,811,163 | 3/1989 | Fletcher | 307/64 |
| 4,885,654 | 12/1989 | Budyko et al. | 361/13 |
| 4,922,363 | 5/1990 | Long et al. | 361/3 |
| 4,939,776 | 7/1990 | Bender | 361/152 |
| 4,959,746 | 9/1990 | Hongel | 361/13 |
| 4,992,904 | 2/1991 | Spencer | 361/8 |
| 5,014,036 | 5/1991 | Komoto | 337/407 |
| 5,081,558 | 1/1992 | Mahler | 361/13 |
| 5,206,782 | 4/1993 | Landmeier et al. | 361/154 |

FOREIGN PATENT DOCUMENTS

| | | | |
|---|---|---|---|
| 967232 | 5/1975 | Canada | 361/104 |
| 555863 | 3/1921 | France | 361/104 |

*Primary Examiner*—William M. Shoop, Jr.
*Assistant Examiner*—Peter Ganjoo
*Attorney, Agent, or Firm*—Russell E. Baumann; Richard L. Donaldson; René E. Grossman

[57] ABSTRACT

A high voltage, high current DC switch is shown having a single pole, double throw relay and a solid state power switch such as an IGBT or MOSFET transistor. Voltage is switched by means of the solid state switch while steady state current is conducted through the relay load contact. Several different protector devices are used in the event of circuit malfunction including a combination of thermal and current fuses and resettable thermostats.

27 Claims, 4 Drawing Sheets

HIGH VOLTAGE, HIGH CURRENT SWITCHING APPARATUS

This invention relates generally to switching of electric loads and more specifically to switching of high voltage, high DC current.

Switching of low voltage, high current loads can be accomplished using standard, low voltage electromechanical relays or solid state devices. The use of electromechanical relays is possible due to the fact that low voltage systems will not cause contact arcing which could destroy the relay, and due to the fact that relays have low contact resistance. The use of solid state devices is possible due to the fact that low voltage solid state devices, e.g., low voltage MOSFETs, have low "on" resistance resulting in low steady state switch power dissipation which can be effectively handled. However, switching of high voltage, high current loads using either solid state devices or standard, low voltage relays does not offer a practical solution. Switching high voltage loads using standard, low voltage relays would lead to contact arcing resulting in destruction of the relay. Switching high voltage, high current loads using solid state devices would require the use of an excessive number of such devices connected in parallel in order to reduce the power dissipation to acceptable levels, for example, high power dissipation of suitable solid state devices is due to the inherently high "on" resistance of high voltage MOSFETs or the saturation voltage of IGBTs, thereby making the approach impractical from a cost and size standpoint. Relays are available for switching high voltage, high current loads, e.g., vacuum relays, but their cost and size make them impractical in many applications. High voltage electromechanical relays have further limitations due to low cycle life.

It is therefore the object of this invention to provide an apparatus for switch high voltage, high current circuits in a safe, economic manner, while also providing a switching apparatus with high cycle life.

Briefly, in accordance with the invention, a single pole, double throw relay is used in combination with a solid state device comprising, in alternative embodiments, a MOSFET transistor or variation thereof and an IGBT transistor wherein the voltage is switched through the solid state switch as the movable relay contact starts to move from one position, e.g., normally closed contact position, to the opposite position, e.g., normally open contact position, so that as the movable relay contact approaches and engages the normally open contact there is insufficient voltage differential to initiate any significant arc. As long as the load is energized there are two current paths, one through the relay and one through the solid state device but with the relay conducting virtually all the current due to its very low resistance path. When the relay is de-energized the movable relay contact will move away from the normally open contact, however, due to the solid state device being on the load current is still flowing so that there is insufficient voltage differential across the relay contacts to initiate any significant arc. The movable contact then engages the normally closed contact and turns off the solid state switch.

According to another feature of the invention a thermal protector is provided to open the switch circuit in the event of a circuit malfunction. The thermal protector, in one embodiment, comprises a combination of thermal fuses in parallel and a parallel connected current fuse of increased resistance. The number of thermal fuses is selected so that the self-heating due to normal operating currents is well below the trip temperature of the thermal fuse, and the current fuse chosen at a safe low rating. In an alternate embodiment resettable thermostats are mounted on the heat sink of the power switch and is adapted to shut off the power switch upon overheating.

Various other objects and advantages will appear from the following description of preferred embodiments of the invention and the novel features will be particularly pointed out hereinafter in connection with the accompanying drawings and the appended claims.

Figure 1:
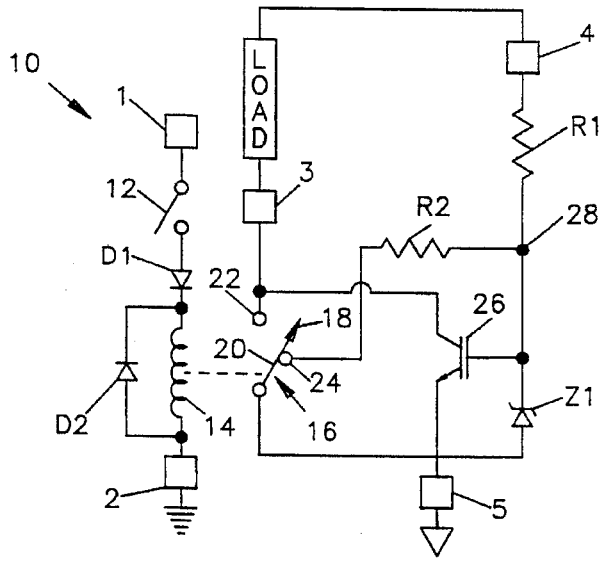
FIG. 1 is a schematic circuit diagram of a high voltage, high current DC switch made in accordance with the invention.

Turning now to the drawings with particular reference to FIG. 1, numeral 10 refers to a high voltage, high current DC switching system made in accordance with the invention. The system comprises a first low voltage circuit comprising an on/off switch 12 connected to a relay coil 14 between a low voltage source or positive signal voltage at terminal 1 and ground or negative signal voltage at terminal 2. A diode D2 prevents back EMF from causing potential coil to contact arcing while diode D1 prevents damage to D2 in the event that the circuit is miswired. A second, high voltage circuit includes a single pole, double throw relay switch 16 comprising a common, movable contact 18 mounted on a movable contact arm 20, a first normally open load contact 22 and a second normally closed contact 24. When relay coil 14 is energized contact arm 20 will move contact 18 into engagement with first load contact 22, and when the coil is de-energized contact arm 20 will move contact 18 into engagement with second contact 24. The second, high voltage circuit includes solid state power switch 26 in the form of an IGBT 26, an insulated gate bipolar junction transistor having a gate terminal and emitter and collector main terminals. A first current path comprises resistor means including resistor R1 serially connected to resistor R2 forming a voltage divider between high voltage, positive terminal 4 and high voltage negative terminal 5 through normally closed contact 24. The junction 28 of the voltage divider is connected to the gate of IGBT 26. A second current path includes the main terminals of IGBT 26 which are connected between the low side, load terminal 3 and terminal 5. A zener diode Z1 is connected between the voltage divider and terminal 5 to limit the voltage across the gate and emitter of IGBT 26 to a selected level.

The value of resistor R2 is chosen so that the voltage at junction 28 is only a small fraction of the supply voltage when contact 18 is in engagement with contact 24. By way of example, if the resistance of resistor R1 is X and the value of R2 is approximately 1/1000 X, then if the supply voltage is approximately 200 volts the voltage at junction 28 will only be approximately 0.2 volts. In the off state switch 12 is open and coil 14 is de-energized with movable contact 18 in engagement with normally closed contact 24, also solid state switch 26 is off since voltage across junction 28 and terminal 5 and hence the gate emitter voltage is less than the approximatey 1 and ½ volts needed to turn it on, therefore there is no load current flowing.

Figure 2A:
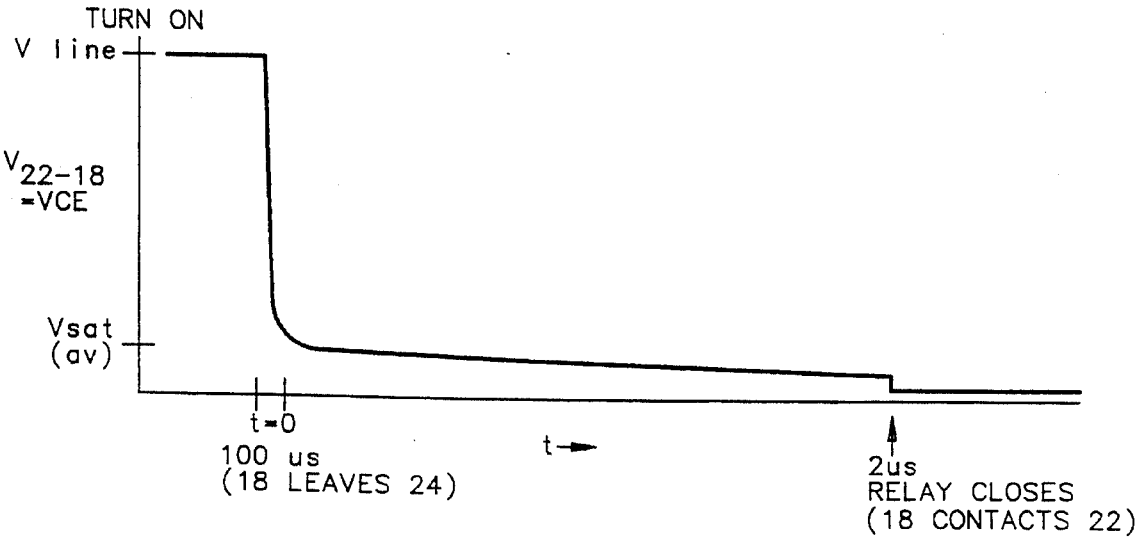
FIGS. 2*a* and 2*b* are timing diagrams showing voltage across the load contacts as the relay switch is turned on (FIG. 2*a*) and off (FIG. 2*b*)

Upon closing switch 12 thereby energizing coil 14, movable contact 18 starts to move and as soon as it leaves contact 24 the pull down of the gate is removed and the gate will begin to charge through resistor R1 turning on switch 26 very quickly, e.g., on the order of 100 microseconds. Current then begins to flow through the main terminals of switch 26. Since the time required for contact 18 to move from contact 24 to contact 22 is much greater than the switch 26 turn on time, that is, the time required for contact 18 to travel the distance between contacts is on the order of approximately 2 milliseconds, contact 18 will have traveled only a small fraction, e.g., approximately 1/20 of the distance between the contacts by the time that switch 26 is fully on. With reference to FIG. 2*a* showing a timing diagram with voltage across contacts 22–18 versus time it will be seen that when contact 18 leaves contact 24, t=0, it takes about 100 microseconds to turn on solid state switch 26, during which time the voltage rapidly decreases to the saturation level of approximately 2 volts and remains at this level until contact 18 engages contact 22 thereby eliminating arcing during contact bounce. Due to the fact that the voltage drop across relay contacts 22 and 18 is much lower than the saturation voltage of switch 26, nearly all steady state current will flow through the relay.

Figure 2B:
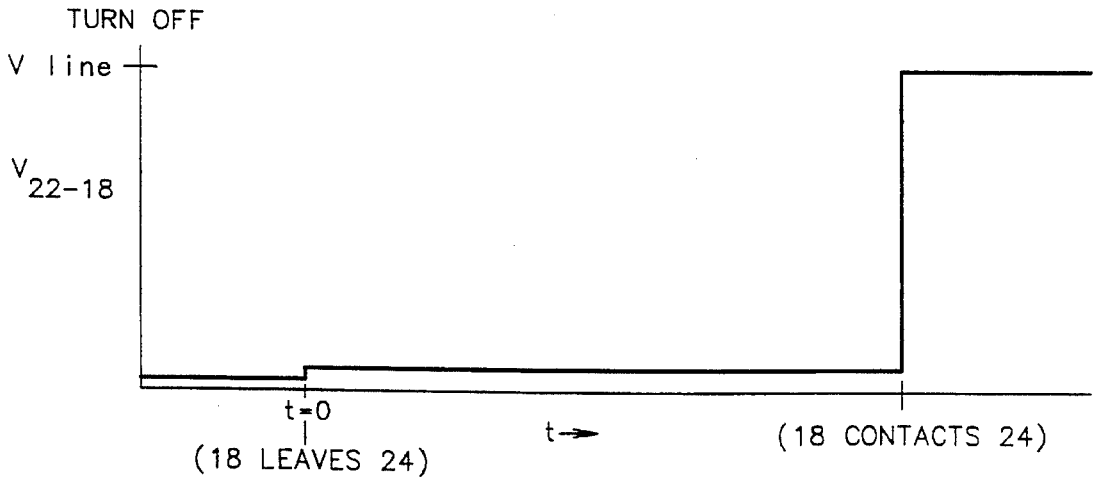

When switch 12 is opened thereby de-energizing coil 14, movable contact 18 starts to move away from contact 22 and since power switch 26 is already on all the current will flow through the power switch until contact 18 engages normally closed contact 24 turning off switch 26, thereby turning the load off. As seen in FIG. 2*b*, when contact 18 leaves contact 22 at t=0 the voltage across contacts 18 and 22 is limited to the saturation voltage of approximately 2 volts which is insufficient potential difference to initiate and sustain an arc at contact 18.

Once movable contact 18 leaves the normally closed contact 24 the power switch starts to switch on and will complete its turn on prior to contact 18 engaging with load contact 22. When contact 18 engages load contact 22 two parallel currents paths are formed with virtually all current flowing through the relay contacts. During normal operation the inherent low on resistance of the relay switch contacts and the associated switch structure can easily dissipate all the heat generated so that no additional heat sinking is required. Further, the normal package of the IGBT is adequate to dissipate heat generated within the IGBT during the time required for contact 18 to move from contact 24 to contact 22.

Figure 3:
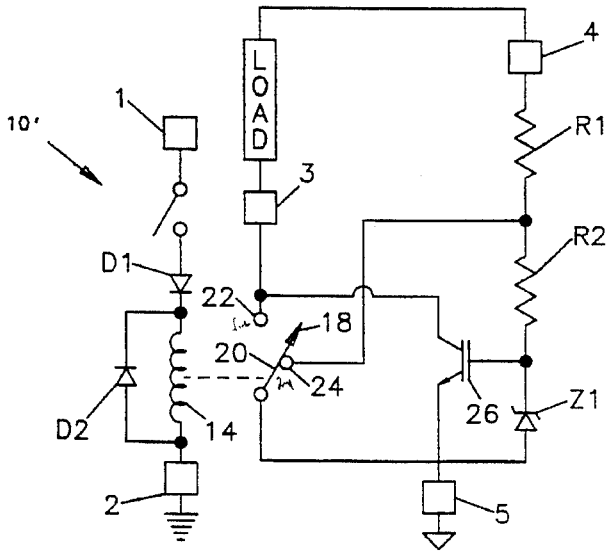
FIGS. 3 and 4 are schematic circuit diagrams of modifications of the FIG. 1 circuit.

FIG. 3 shows a modification of the FIG. 1 embodiment in which resistor R2 is not formed as part of the voltage divider but instead is connected directly to the gate of power switch 26. In other respects the operation of the circuit is the same as that of FIG. 1 and need not be repeated.

Figure 4:
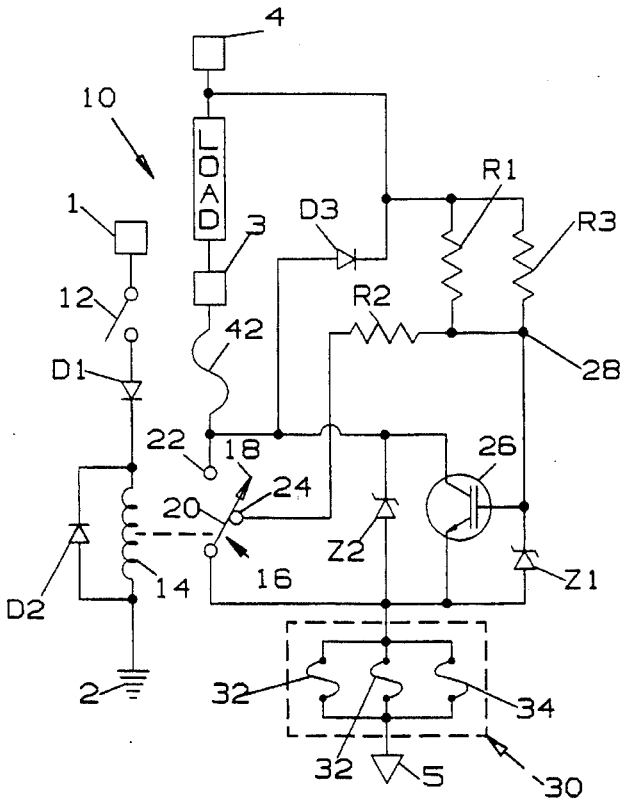

FIG. 4 shows another modification of the FIG. 1 embodiment which adds several safety features. One such feature is the provision of an additional resistor R3 connected in parallel with R1. An open circuit across resistor R1 would result in not being able to turn on switch 26 and this possibility is essentially obviated with the addition of resistor R3.

In the event of a mechanical relay malfunction or other circuit malfunction which causes the solid state device to remain on, the solid state device will carry full load current and will sustain damage due to overheating from continual high power dissipation. A thermal protector 30 is provided to deal with this possibility. Thermal protector 30 comprises one or more thermal fuse element 32 and a current fuse element 34 of higher resistance, all connected in parallel between contact 18 and terminal 5, the negative side of the circuit. The particular number of thermal fuse elements selected is based on limiting self-heating at normal operating currents well below the trip temperature of the thermal fuse. The resistance of the thermal fuse 32 is chosen to be lower than the current fuse 34 and therefore will carry the bulk of the load current. For example, the chosen ratios of current fuse to thermal fuse resistance are on the order of 50:1. The thermal protector is placed in close proximity to the solid state switch and is adapted to be actuated by overheating of the solid state switch due to circuit malfunction. Heating caused by any such malfunction would cause the thermal fuse element 32 to trip open thereby transferring full load current to the current fuse 34 which would then blow open safely shutting the circuit off. The current fuse serves two functions. Its current rating is selected first to prevent arc damage within the thermal fuse when the thermal fuse opens and second to prevent thermal damage to the solid state switch by opening the high voltage circuit.

On one hand, thermal fuses are not rated to switch high voltages but can withstand relatively high voltages in the open condition without breakdown. On the other hand, fast blow current fuses can safely switch high voltages. The combination of fuse elements of protector 30 allows each component to be used within its rating and safely shut off in the event of circuit malfunction. Yet another advantage of protector 30 is that it comprises low cost and readily available individual components thereby adding minimal cost to the system.

Also shown in FIG. 4 is a zener diode Z2 coupled across the main terminals of IGBT 26 to protect the power switch from voltage transients above a selected level. A diode D3 is connected across load terminal 3 and terminal 4 to protect the power switch from voltage transients caused by load back EMF. Also shown is current fuse 42 serially connected to the load terminal in the event that current through the load exceeds a selected value, e.g., 40 amps, due to a load fault. It will be appreciated that fuse 42 could also be provided in the system to which terminal 4 is connected.

A system made in accordance with FIG. 4 has the following components:

| | | | |
|---|---|---|---|
| Low Voltage Source | 12 VDC | | |
| High Voltage Source | 50–350 VDC | | |
| SPDT Relay | 12 Volt Coil | R1 | 50K OHM - 1 W |
| 16 | 40 AMP Contacts | R2 | 150K OHM - ¼ W |
| D1 | 1N4007 | R3 | 150K OHM - 1 W |
| D2 | 1N4007 | Fuses 32 | Open 1400 C |
| D3 | 1N4007 | Fuses 34 | 2 AMP |
| Z1 | 15 $V_Z$ | Fuse 42 | 40 AMP |
| Z2 | 400 $V_Z$ | | |
| Power Switch 26 | 40 AMP 600 V | | |

The above embodiments have been described with an IGBT transistor employed as the solid state switch because of its considerable advantages in many applications, particularly, high current switching. However, in many applications various types of MOSFET transistors can also be used and may be preferred due to their lower individual cost.

Figure 5:
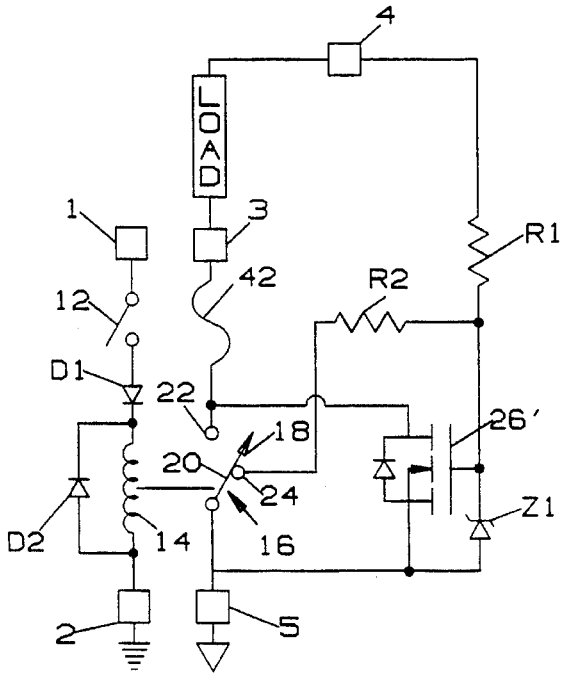
FIGS. 5 and 6 are schematic circuit diagrams of additional modifications of the FIG. 1 circuit.

FIG. 5 shows an embodiment similar to FIG. 1 but specifically employing a MOSFET as the power switch 26'. Since the operation of the circuit is otherwise the same as that of FIG. 1, its description need not be repeated. A system made in accordance with FIG. 5 includes the following components:

| FIG. 5 Embodiment | |
|---|---|
| Low Voltage Source | 12 VDC |
| High Voltage Source | 50–350 VDC |
| D1 | 1N4007 |
| D2 | 1N4007 |
| SPDT Relay 16 | 12 Volt Coil<br>40 AMP Contacts |
| Fuse 42 | 40 AMP |
| Z1 | 15 $V_Z$ |
| R1 | 150K ohm - 1 W |
| R3 | 100 ohm - ¼ W |
| Power Switch 26' | 13 AMP 500 V on heat sink |

Figure 6:
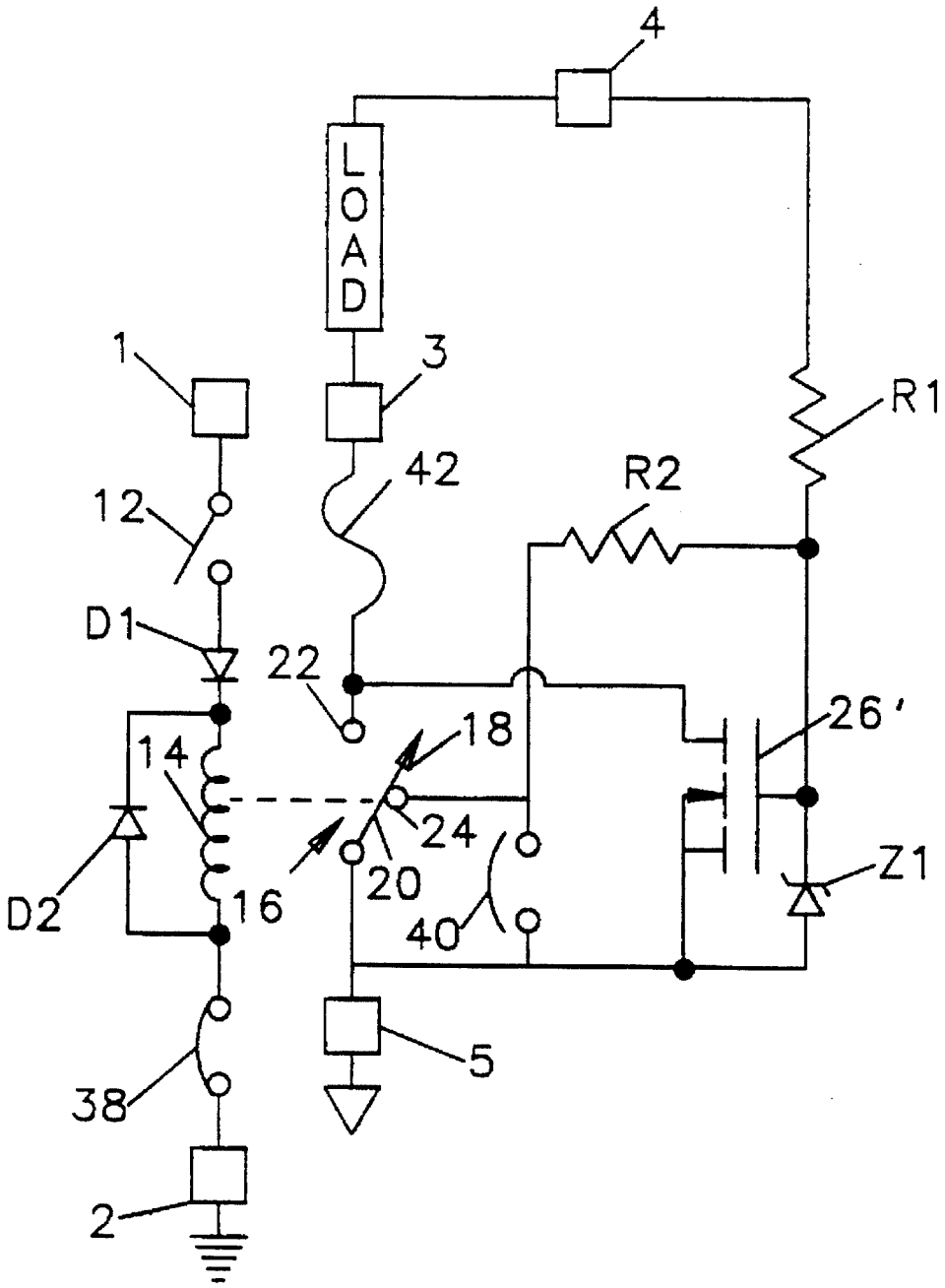

FIG. 6 shows a modification of the FIG. 5 embodiment adding a resettable protector in the form of a normally closed resettable thermostat 38 mounted in heat transfer relation with switch 26' and connected in series with coil 14. Thermostat 38 is designed to open when the switch 26' reaches a selected temperature, e.g., 70° C., due to a circuit malfunction to de-energize relay coil 14. A normally open resettable thermostat is also mounted in heat transfer relation with the power switch 26', for example, on the heat sink thereof. The thermostat is chosen so that it will close at a selected temperature, e.g., 100° C., so that if the power switch should reach that temperature due to some circuit malfunction the thermostat will close removing bias from switch 26' turning it off. The actuation temperature of thermostats 38 and 40 are chosen so that the coil is disabled before the power switch is turned off. This serves to prevent a user from potentially causing a relay failure by switching full system voltage by attempting to energize the coil when the solid state switch is disabled. Further, even if the tripping of thermostat 38 failed to result in the movable contact returning to normally closed contact 24, thermostat 40 would be effective to limit temperature excursions of switch 26' to 100° C. It will be appreciated that the resettable protector can also be used with an IGBT as the power switch.

A system made in accordance with FIG. 6 includes the following components:

| FIG. 6 Embodiment | |
|---|---|
| Low Voltage Source | 12 VDC |
| High Voltage Source | 50–350 VDC |
| D1 | 1N4007 |
| D2 | 1N4007 |
| SPDT Relay 16 | 12 Volt Coil<br>40 AMP Contacts |
| Fuse 42 | 40 AMP |
| Thermostat 38 | N.O. 100° C. |
| Thermostat 40 | N.C. 70° C. |
| Z1 | 15 $V_Z$ |
| R1 | 150K ohm - 1 W |
| R3 | 150 ohm - ¼ W |
| Power Switch 26' | 2X 13 AMP 500 V<br>on heat sink with<br>thermostats 38, 40<br>each FET 0.4 ohms max.<br>0.5° C./W |

Although the invention has been described with respect to specific, preferred embodiments thereof, many variations and modifications will become apparent to those skilled in the art. It will be understood that either resettable or non-resettable protection devices can be used with either an IGBT or a MOSFET as the power switch and that the transient suppressor, Z2 and diode D3, although only shown in FIG. 4, can be used with any of the embodiments. A system made in accordance with the invention, while having particular utility for switching electric heat loads in electrically powered automobiles and the like has utility wherever the switching of high voltage is called for. Further, it is within purview of the invention to use a manual switch to effect movement of contact arm 20 in place of the low voltage circuit of switch 12, coil 14, if desired. It is the intent that the appended claims be interpreted as broadly as possible, in view of the prior art to include all such variations and modifications.

We claim:

1. Relay apparatus for switching high voltage, high current DC circuits comprising:

a first low voltage circuit having a low voltage power source, an on/off switch and a relay coil, a second high voltage circuit having a relay switch comprising a movable common contact connected to the high voltage negative side of the circuit, a first normally open contact and a second normally closed contact, a contact arm mounting the movable contact with the movable contact movable in response to energization of the relay coil between the first and second contacts, a high voltage power source and a load terminal connected to the first normally open contact, a solid state power switch having main terminals and a terminal to control the state of energization of the power switch, a first current path comprising resistor means connected to the second normally closed contact, the high voltage source and the terminal controlling the state energization of the power source switch, and a zener diode connected between the terminal controlling the state of energization of the power switch and the common contact, a second current path in which the main terminals of the power switch are connected between the first normally open contact and the common contact, energization of the relay coil causing the movable common contact to move out of engagement with the second normally closed contact to increase the voltage of the said terminal to control the state of energization of the power switch through the resistor means to energize the power switch after the movable common contact has moved out of engagement with the second normally closed contact and prior to the engagement of the movable common contact with the first normally open contact and maintain the power switch energized until the movable common contact moves back into engagement with the second normally closed contact following de-energization of the relay coil.

2. Relay apparatus according to claim 1 in which the resistor means forms a voltage divider connected to the high voltage source and the terminal controlling the state of energization of the power switch, with the junction of the voltage divider resistors connected to the second normally closed contact.

3. Relay apparatus according to claim 1 in which the solid state power switch comprises at least one IGBT transistor.

4. Relay apparatus according to claim 1 in which the solid state power switch includes at least one MOSFET transistor.

5. Relay apparatus according to claim 2 in which the resistor means comprises at least two parallel connected resistors.

6. Relay apparatus according to claim 1 including thermal protector means comprising thermal fuse means disposed in heat transfer relation with the solid state power switch and a current fuse connected in parallel with the thermal fuse means.

7. Relay apparatus according to claim 6 in which the thermal fuse means comprises at least two parallel connected thermal fuses.

8. Relay apparatus according to claim 1 including a normally open thermostat and a normally closed thermostat mounted in heat transfer relation with the solid state power switch.

9. Relay apparatus for switching high voltage, high current DC circuits comprising:

a first low voltage circuit having a low voltage power source, an on/off switch and a relay coil, a second high voltage circuit having a relay switch comprising a movable common contact, a first normally open contact and a second normally closed contact, a contact arm mounting the movable contact with the movable contact movable in response to energization of the relay coil from the second to the first contact and upon de-energization from the first contact to the second contact, a high voltage power source and a load terminal connected to the first normally open contact, a solid state power switch having main terminals and a terminal to control the state of energization of the power switch, a current path in which the main terminals of the power switch are connected between the first normally open contact and the common contact, and means for biasing the solid state switch on upon energization of the relay coil as soon as the movable contact moves away from the second contact turning on the solid state switch before the movable contact engages the first contact, essentially all the current from the high voltage source flowing through the first contact after the movable contact engages the first contact with the bias being maintained on the solid state switch, and upon de-energization of the relay coil with the solid state switch still biased on, current flow through the first contact being interrupted when the movable contact leaves the first contact and means for removing the bias from the solid state switch when the movable contact engages the second contact.

10. Relay apparatus according to claim 9 in which the means for biasing the solid state power switch includes:

another current path comprising resistor means forming a voltage divider connected to the second contact and the high voltage source and the terminal controlling the state of energization of the power switch being coupled to the junction of the voltage divider resistors and a zener diode connected between the terminal controlling the state of energization of the power switch and the common contact.

11. Relay apparatus according to claim 10 in which the resistor means forming the voltage divider is connected to the high voltage source and the terminal controlling the state of energization of the power switch, with the junction of the voltage divider resistor connected to the second normally closed contact.

12. Relay apparatus according to claim 10 in which the solid state power switch comprises at least one IGBT transistor.

13. Relay apparatus according to claim 10 in which the solid state power switch includes at least one MOSFET transistor.

14. Relay apparatus according to claim 10 in which the resistor means comprises at least two parallel connected resistors.

15. Relay apparatus according to claim 10 including thermal protector means comprising at least two parallel connected thermal fuses disposed in heat transfer relation with the solid state power switch and a current fuse connected in parallel with the thermal fuses.

16. Relay apparatus according to claim 10 including a normally open thermostat and a normally closed thermostat mounted in heat transfer relation with the solid state power switch.

17. Apparatus for switching high voltage, high current DC circuits comprising:

a high voltage circuit having a switch comprising a movable common contact, a first normally open contact and a second normally closed contact, a contact arm mounting the movable contact with the movable contact movable between the first and second contacts, a high voltage power source and a load terminal connected to the first normally open contact, a solid state power switch having main terminals and a terminal to control the state of energization of the power switch, a current path in which the main terminals of the power switch are connected between the first normally open contact and the common contact, and means for biasing the solid state switch on as soon as the movable contact moves away from the second contact turning on the solid state switch before the movable contact engages the first contact, essentially all the current from the high voltage source flowing through the first contact after the movable contact engages the first contact with the bias being maintained on the solid state switch keeping the solid state switch on, current flow through the first contact being interrupted when the movable contact leaves the first contact and means for removing the bias from the solid state switch to turn the switch off when the movable contact engages the second contact.

18. Apparatus according to claim 17 in which the means for biasing the solid state power switch includes:

another current path comprising resistor means forming a voltage divider connected to the high voltage source and the terminal controlling the state of energization of the power switch with the junction of the voltage divider resistors connected to the second normally closed contact and a zener diode connected between the terminal controlling the state of energization of the power switch and the common contact.

19. Apparatus according to claim 18 in which the solid state power switch comprises is an IGBT transistor.

20. Apparatus according to claim 18 in which the solid state power switch includes at least one MOSFET transistor.

21. Apparatus according to claim 18 including thermal protector means comprising thermal fuse means disposed in heat transfer relation with the solid state power switch and a current fuse connected in parallel with the thermal fuse means.

22. Apparatus according to claim 18 including a normally open thermostat mounted and a normally closed thermostat in heat transfer relation with the solid state power switch.

23. Relay apparatus according to claim 22 in which the normally closed thermostat is adapted to open approximately 70° C. and the normally open thermostat is adapted to close at approximately 100° C.

24. Apparatus according to claim 17 in which the means for biasing the solid state power switch includes:

another current path comprising resistor means forming a voltage divider connected to the second contact and the high voltage source and the terminal controlling the state of energization of the power switch being coupled to the junction of the voltage divider and the common contact; and a zener diode connected between the terminal controlling the state of energization of the power switch and the common contact.

25. Apparatus according to claim 24 in which the resistor means forming the voltage divider comprises first and second resistor means, the first resistor means being coupled to the high voltage source and the second resistor means being coupled to the second normally closed contact, the second resistor means having a relatively small value relative to the first resistor means.

26. Apparatus according to claim 25 in which the second resistor means has a value of approximately one one-thousandths that of the first resistor means.

27. Apparatus according to claim 25 in which the first resistor means comprises at least two parallel connected resistors.

* * * * *